US007603817B2

(12) United States Patent
Lewis

(10) Patent No.: US 7,603,817 B2
(45) Date of Patent: Oct. 20, 2009

(54) APPARATUS FOR SUPPORTING MOLDING PIECES

(75) Inventor: Thomas M. Lewis, 141 Cricket La., Orange, CT (US) 06477

(73) Assignee: Thomas M. Lewis, Orange, CT (US)

( * ) Notice: Subject to any disclaimer, the term of this patent is extended or adjusted under 35 U.S.C. 154(b) by 618 days.

(21) Appl. No.: 11/092,646

(22) Filed: Mar. 29, 2005

(65) Prior Publication Data

US 2006/0218868 A1 Oct. 5, 2006

(51) Int. Cl.
*E04G 21/04* (2006.01)

(52) U.S. Cl. ..... 52/127.2; 52/127.1; 52/749.1; 52/DIG. 1; 248/351

(58) Field of Classification Search ..... 52/127.2, 52/127.1, 749.1, DIG. 1; 29/270, 278; 294/19.1; 269/904, 254 CS, 258, 266, 3, 6, 73, 95; 248/351, 354.1, 354.4, 285.1, 286.1, 122.1
See application file for complete search history.

(56) References Cited

U.S. PATENT DOCUMENTS 2,273,813 A * 2/1942 Barber ..... 248/124.2
4,576,354 A * 3/1986 Blessing, Sr. ..... 248/354.5
4,695,028 A * 9/1987 Hunter ..... 248/354.1
6,508,448 B1 * 1/2003 Stewart ..... 248/354.1

* cited by examiner

*Primary Examiner*—Richard E Chilcot, Jr.
*Assistant Examiner*—Joshua Ihezie

(57) ABSTRACT

An apparatus for supporting a molding piece such as a piece of chair molding or crown molding against a wall surface at a prescribed distance from a floor surface. The apparatus includes an elongate body having opposing first and second ends and a head assembly coupled to the first end of the elongate body. The head assembly is configured to encapsulate and support a portion of the molding piece that is disposed adjacent the wall surface at a prescribed distance from said floor surface while the second end of the elongate body is disposed adjacent to the floor surface and the first end of the elongate body is disposed adjacent the wall surface. The apparatus thereby supports the encapsulated portion of the molding piece that is disposed adjacent the wall surface at said prescribed distance from said floor surface without further intervention.

13 Claims, 5 Drawing Sheets

APPARATUS FOR SUPPORTING MOLDING PIECES

I. FIELD OF THE INVENTION

The present invention relates in general to an apparatus for supporting a molding piece against a wall surface during installation of the molding piece, and more particularly, to an adjustable apparatus that supports and positions various sizes and configurations of molding pieces against a wall surface enabling a single installer to install a molding piece against a wall surface at a desired position.

II. BACKGROUND OF THE INVENTION

Crown molding serves several important aesthetic and utilitarian functions, including the obscuring of the rough and abrupt intersection of a ceiling and wall, the general enhancement and refinement of the decor and design of a room, and the stabilization of some wall coverings where they intersect with a ceiling. However, because of the inherently elevated, overhead location of crown molding, installation can be cumbersome and difficult, and often requiring the cooperation of two or more workers due particularly to the length of crown molding to be installed.

However, two or more workers are often not available or free to assist in the installation of a crown molding piece, which thus causes delays in the installation of the crown molding, or perhaps even causing a user to forego installing crown molding due to the unavailability of an assistant, which is often the scenario for a homeowner.

Accordingly, it is an object of the present invention to provide an apparatus that enables a single worker to install molding pieces (e.g., crown, chair, etc.) of various dimensions and configurations against wall surfaces at various distances from the floor surface.

III. SUMMARY OF THE INVENTION

Therefore, the present invention relates to an apparatus for supporting a molding piece, such as chair molding or crown molding, against a wall surface at a prescribed position and distance from a floor surface when the molding piece is to be mounted to a wall surface. The molding piece is maintained in a supported position by the apparatus without requiring any user intervention, thus a single user is able to position and mount molding pieces against wall surfaces.

Preferably the present invention apparatus includes an elongate body that is configurable to have an adjustable length so as to position and support molding pieces at prescribed distances from the floor surface. The elongate body includes opposing first and second ends wherein a head assembly is preferably pivotally coupled to the first end of the elongate body.

The head assembly is operable and configurable to encapsulate and support a portion of a molding piece that is disposed adjacent a wall surface to which the molding piece is to be mounted to. The head assembly is preferably configurable by a user to form either a first or second configuration whereby when adjusted into a first configuration, the head assembly encapsulates and supports a portion of a molding piece (e.g., chair molding) against a sidewall at a prescribed distance from the floor surface. And when the head assembly is adjusted into the second configuration by a user, the head assembly is operative to encapsulate and support a portion of a molding piece (e.g., crown molding) against a wall joint formed by a sidewall and ceiling wall when the second end of the apparatus is disposed adjacent to the floor surface.

The head assembly is preferably configured to be further adjustable by a user so as to encapsulate and support molding pieces of various dimensions and configurations.

IV. BRIEF DESCRIPTION OF THE DRAWINGS

The above and other objects and advantages of the present invention will be apparent upon consideration of the following description, taken in conjunction with the accompanying drawings, in which like reference characters refer to like parts throughout, and in which.

V. DETAILED DESCRIPTION OF THE INVENTION

The present invention relates to an apparatus for supporting a molding article while the molding article is positioned for mounting. As will be discussed in more detail below, the apparatus of the present invention enables a single user to mount a piece of molding (e.g., crown, chair, etc.) against a wall-mounting surface without requiring assistance from another individual. Thus, the need for requiring at least two individuals to mount a molding article at an elevated position relative to a floor surface is obviated by the present invention apparatus.

Figure 1:
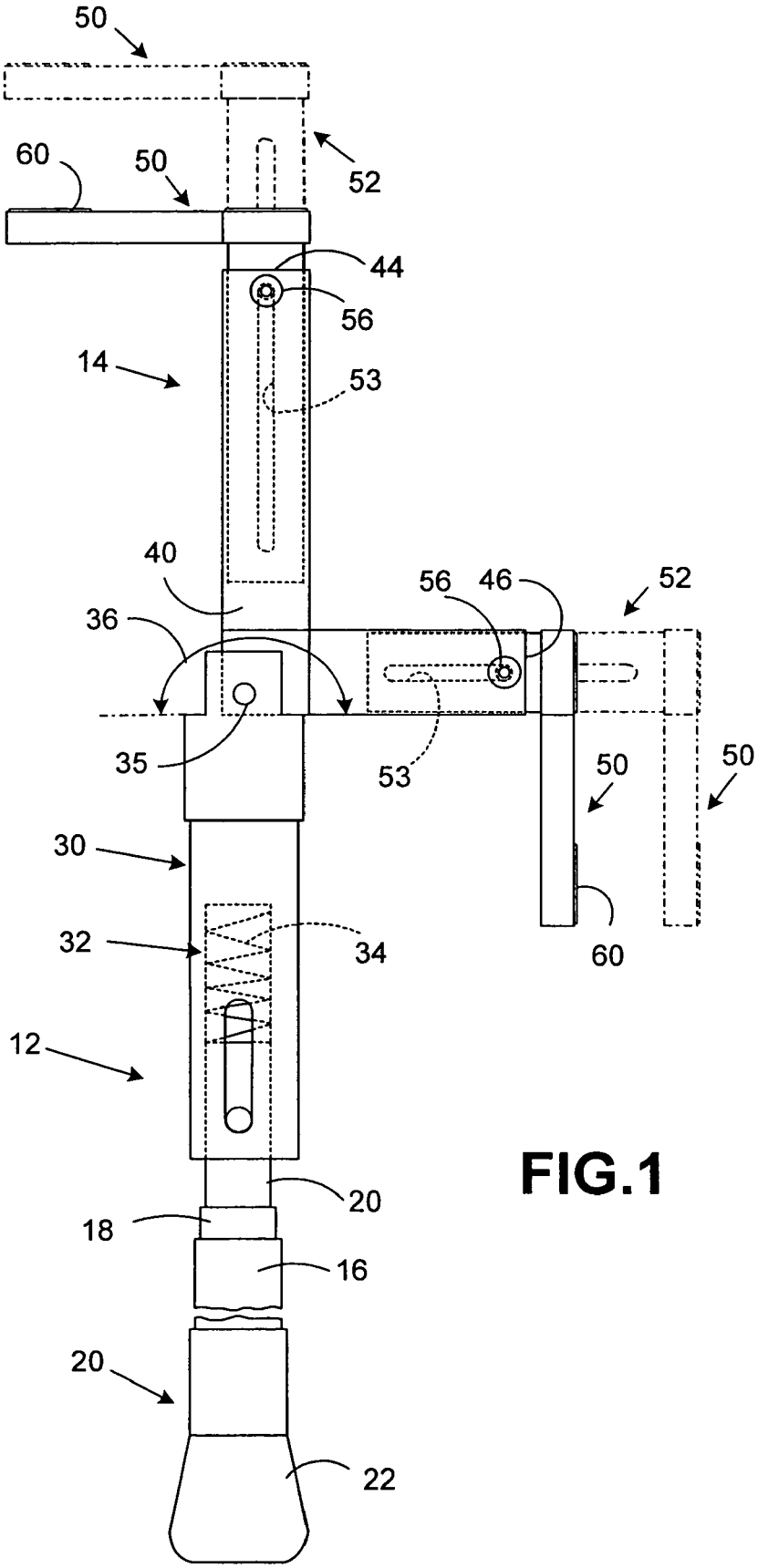
FIG. 1 is a side planar view of the present invention apparatus adapted and configured to support molding pieces against a side wall and ceiling wall.

With reference to FIG. 1, the apparatus is designated generally by reference numeral 10. Apparatus 10 generally includes an extendable elongate body member 12 preferably pivotally coupled to a head member 14. With particular reference now to the body member 12, in the preferred embodiment of FIG. 1 it preferably includes elongate body members 16, 18 and 20, wherein each aforesaid body member is respectively of a reduced diameter relative to one another such that body member 18 slideably receives into body member 16 and body member 20 slideably receives into body member 18. It is to be understood that elongate body member 12 is not to be understood to be limited to having three body members (16, 18 and 20) but rather may encompass as many or few as is necessary for enabling the apparatus 10 to have a desired length.

An advantage of using elongate body members 16, 18 and 20 in body member 12 is that it enables the overall length "L" of body member 12 to be adjustable so as to enable apparatus 10 to support molding pieces 150 at desired distances from a bottom floor surface 100. In the preferred embodiment, body member 18 is lockably adjustable relative to body member 16 and likewise, body member 20 is lockably adjustable relative to body member 18. That is, body member 16 includes a well-known set screw assembly 24 which securely maintains body member 16 to body member 18 when body member 18 extends a desired distance from body member 16. And likewise, body member 18 includes a well-known set screw assembly 26 which securely maintains body member 18 to body member 20 when body member 20 extends a desired distance from body member 18. It is of course to be understood that set-screw assemblies 24 and 26 are not the only types of mechanisms to be used for securing the said body members to one another as any know, or unknown, types of mechanisms for securing the said body members to one another may be used in the present invention apparatus 10.

Preferably mounted on an end of body member 16 (hereinafter the "bottom end") is an end cap 20 that includes a rubber stop member 22. This end cap 20, and particularly the rubber stop member 22, is used to securely position the bottom end of elongate body member 12 against a bottom floor surface 100, as shown in FIG. 1 and further mentioned below.

Figure 2:
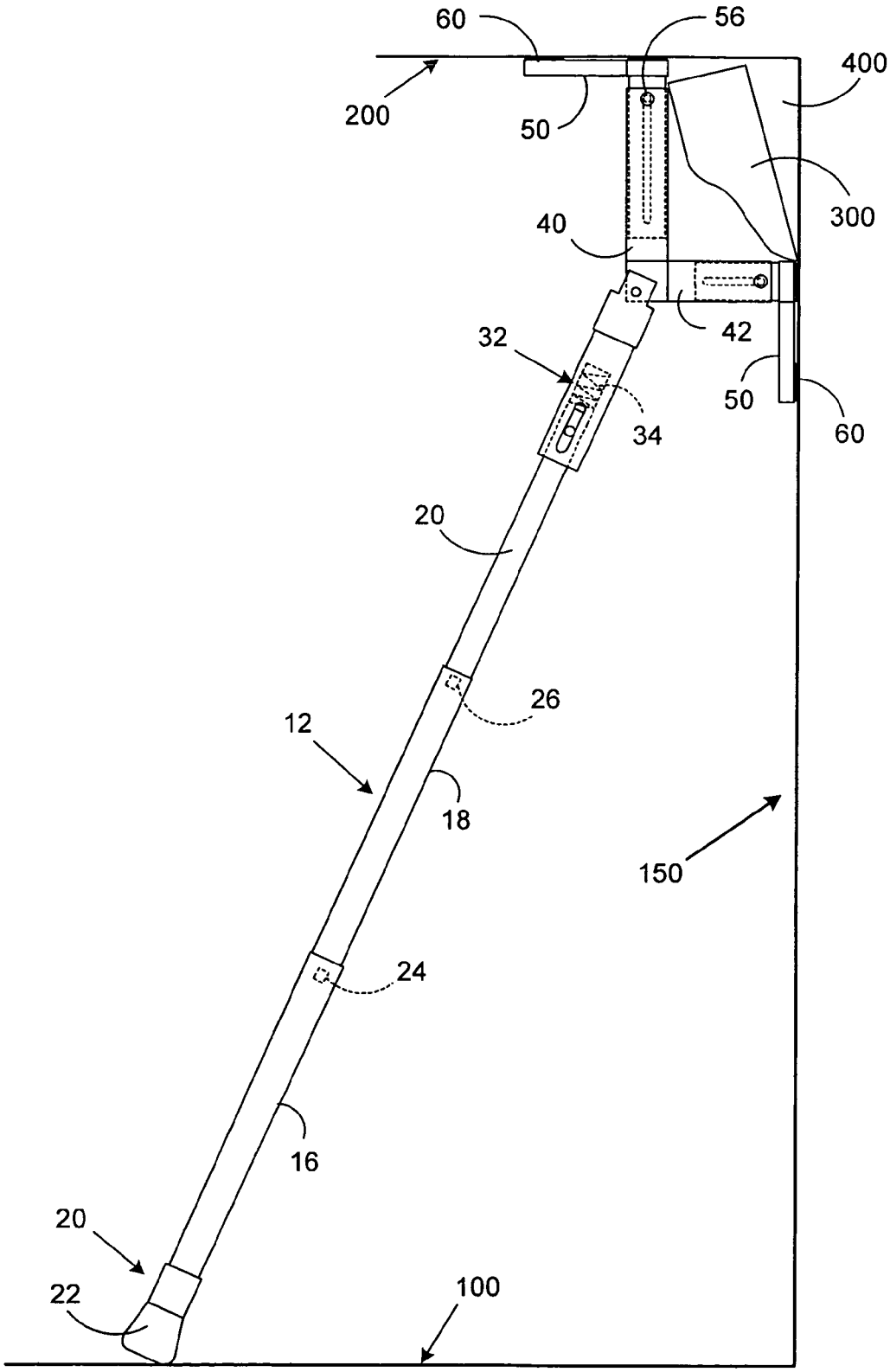
FIG. 2 is a side planar view of the apparatus of FIG. 1 depicting it supporting and positioning a crown molding piece against wall joints formed by a sidewall and a ceiling surface.

Mounted on an end portion of body member 20 (which is the opposing end to the bottom end of apparatus 10 (hereinafter the "top end")) is a head-cap assembly 30 that is slidably received about an end of body member 20. Head-cap assembly 30 includes a spring assembly 32 that enables body member 20, and in turn, elongate member 12, to be spring loaded with respect to head-cap assembly 30. Thus, under the kinetic energy exuded by a spring member 34 included in spring assembly 32, body member 20 moves relative to head-cap assembly 30. It is then noted, and as will be further discussed below, apparatus 10 can then be spring-loaded in a work position as shown in FIGS. 2 and 3 such that its head member 14, and opposing rubber stop member 22 at its bottom end are securely maintained in a position prescribed by a user.

With specific reference now to FIGS. 1 and 3-4, the head assembly 14 of apparatus 10 will now be described. Head assembly 14 is pivotally connected to the aforesaid head-cap assembly 30 preferably via a conventional pin assembly 35. Head assembly preferably pivots about 180° of rotation (as designated by arc numeral 36 in FIG. 1) relative to end cap 30. Head assembly 14 includes an L-shaped member 38 that pivotally connects to the end-cap 30, via the pin assembly 35. The L-shaped member 38 is defined by first and second arm members 40 and 42 that extend and are offset from one another by a 90° angle. The respective end 44 and 46 of each arm member 40 and 42 defines an inner bore portion dimensioned to slideably receive the mounting arm 52 of a T-shaped finger member 50 (as shown in phantom in FIG. 1). The mounting arm 52 is provided with a central cut-out portion 55 dimensioned to receive about a set-screw assembly 56 provided on an end portion 44 and 46 of each respective arm member 40 and 42. Thus, the set-screw assembly 56 is preferably operable to maintain a mounting arm 52 of the T-shaped finger member 50 at a desired location relative to the respective ends 44 and 46 of each arm member 40 and 42, the significance of which will become apparent from discussion further below.

Figure 3:
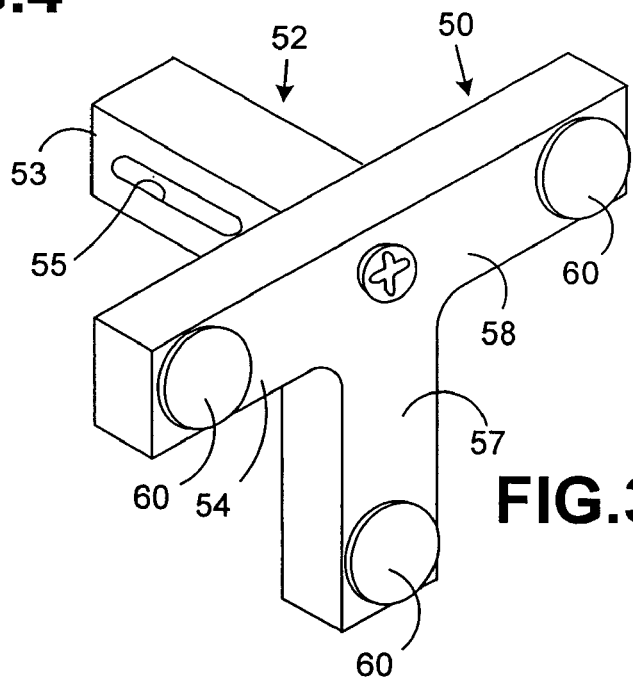
FIG. 3 is a perspective view of a T-shaped finger member used in the apparatus of the present invention.

With particular reference now to FIG. 3, the T-shaped finger member 50 preferably includes arm members 54 and 58 extending in a common plane relative to one another, and extending intermediate and at a 90° relative to arm members 54 and 58 is arm member 57. Preferably, each arm member 54, 56 and 57 is of an equal length relative to one another and are unitarily formed. On an end and front face portion of each arm member 54, 56 and 58 is provided a pad member 60 adapted to contact against a wall surface (see FIG. 5) so as to preferably hold the fingers members 54, 56 and 58 in position against a wall surface while also avoiding any damage to the wall surface. Extending from a rear surface of the T-shaped finger member 50 is the aforesaid mounting arm 52 having the cut-out portion 53 dimensioned to slidably receive within the inner bore portion defined at the ends of each arm member 40 and 42.

As best depicted in the phantom illustrations of FIG. 1, each T-shaped finger member 50 is configured to distally translate a fixed distance from the ends 44 and 46 of each respective arm member 40 and 42. It is noted that a T-shaped finger member 50 is independently adjustable relative to each arm member 40 and 42, so as to enable the head member 14 to accommodate various sizes and configurations of molding pieces.

Figure 4:
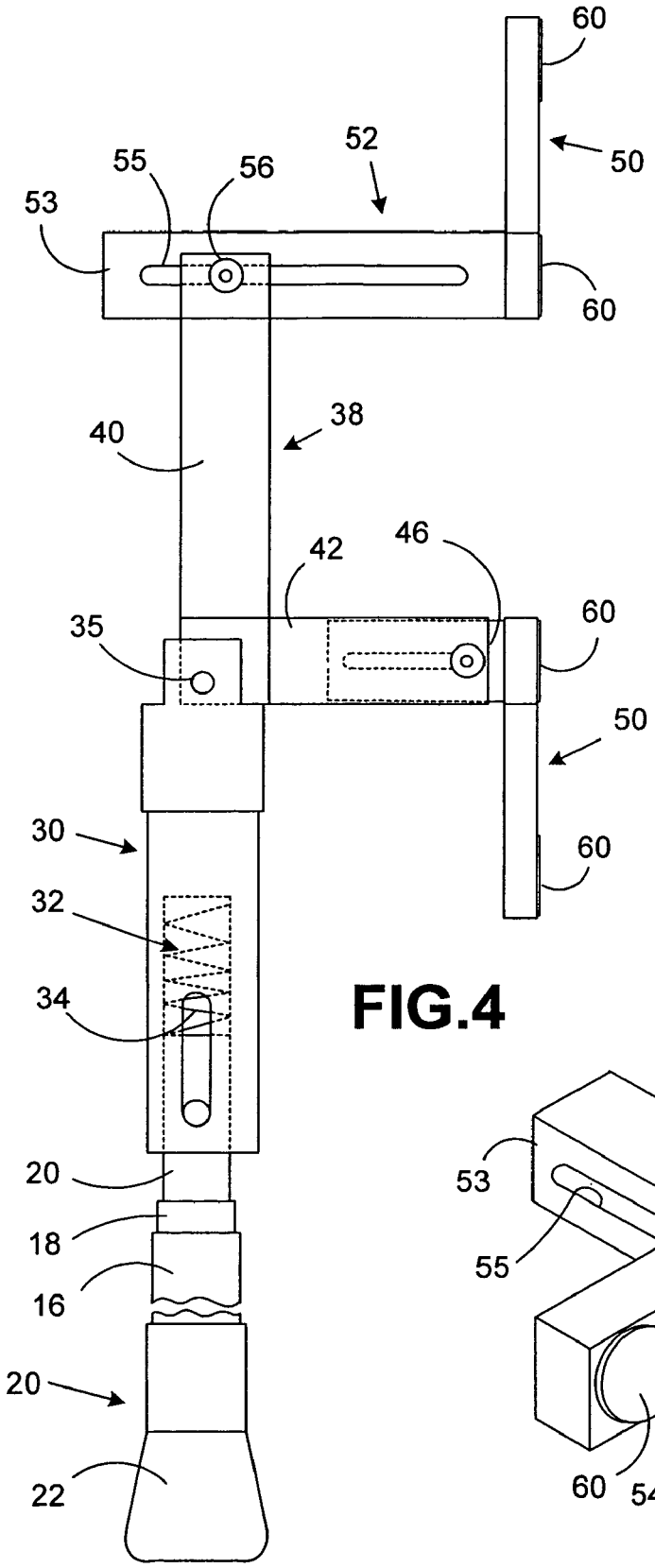
FIG. 4 is a side planar view of the present invention apparatus adapted and configured to support molding pieces against a sidewall surface.

With reference now to FIGS. 1 and 4, the adjustability of a T-shaped finger member 50 relative to upstanding arm member 40 will now be described. As shown in FIG. 1 and previously described, a T-shaped arm member 50 may extend co-planar from the end 44 of arm member 40. In other words, it extends along a common axis relative to the inner bore portion of arm member 40. As will also be described in further detail below, when the head member 14 is in the configuration of FIG. 1, it is particularly adapted to retain and support crown-molding articles 300 that are positioned so as to be mounted in wall corners formed by a side-wall 150 and ceiling wall 200.

Figure 5:
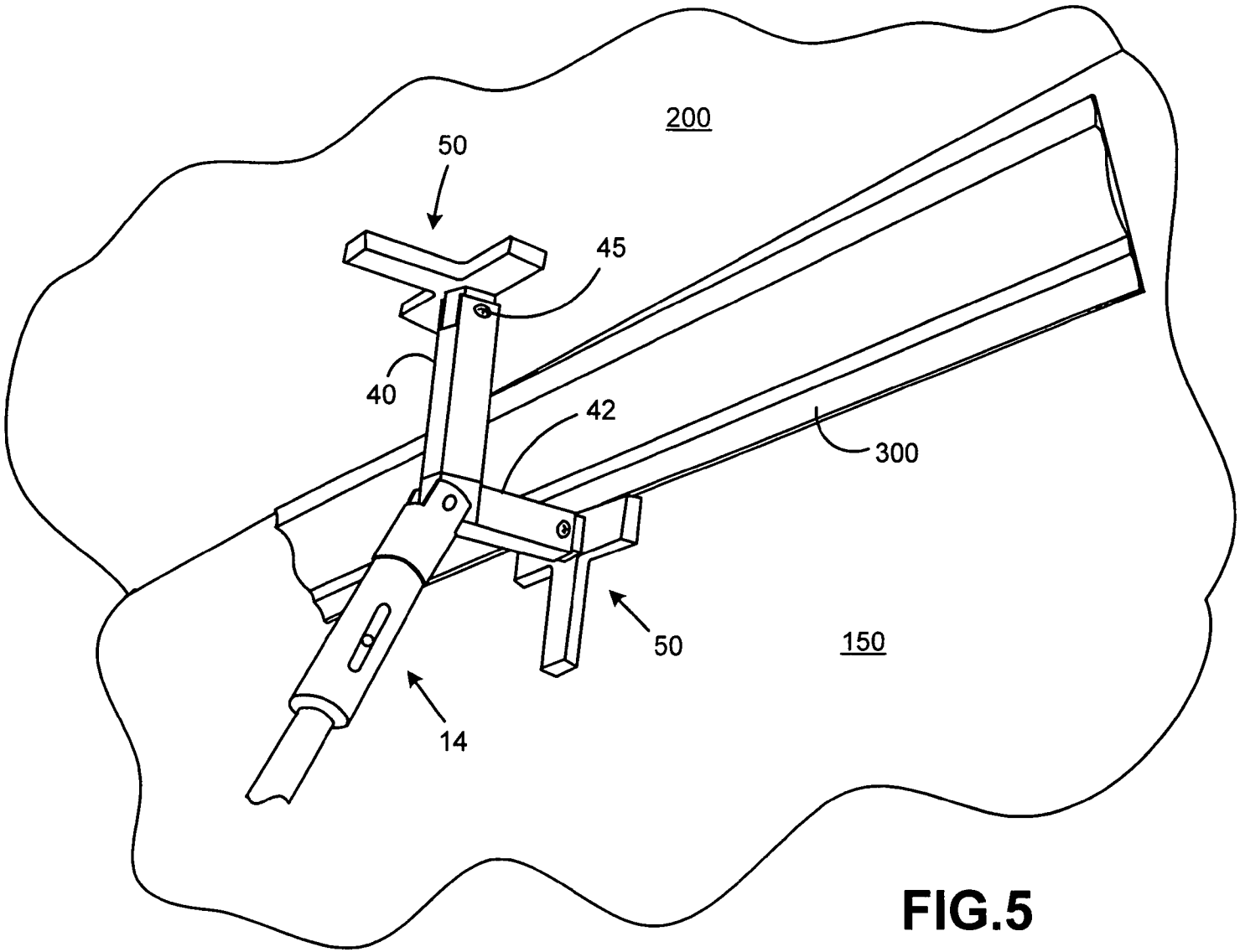
FIG. 5 is a perspective view of the apparatus of FIG. 1 depicting it supporting and positioning a crown molding piece against wall joints formed by a sidewall and a ceiling surface.
Figure 6:
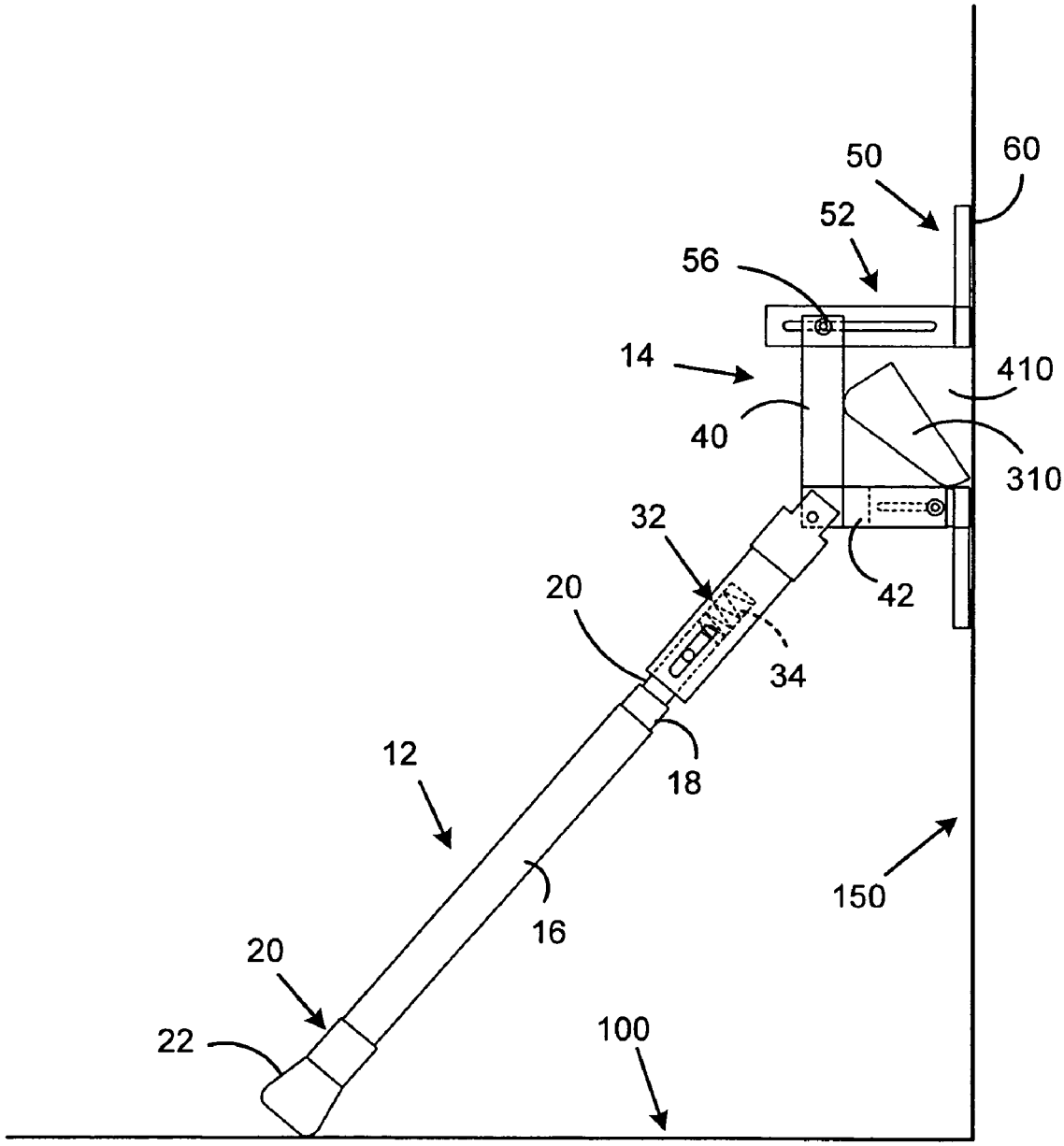
FIG. 6 is a side planar view of the apparatus of FIG. 4 depicting it supporting and positioning a molding piece against a sidewall.

However, in addition to extending co-planar with arm member 40 (FIG. 1), T-shaped member 50 may extend at a right angle relative to arm member 40, as shown in FIGS. 4 and 6. As best shown in FIG. 5, the end 44 of arm member 40 is preferably provided with a cutout portion 45 and as clearly shown in FIG. 4, this cutout portion 45 enables the end 53 of mounting arm 52 to pivot about the set-screw assembly 56 such that the mounting arm 52 translates in a plane (as defined by the longitudinal axis of the mounting arm) that is 90° relative to the plane defined by the longitudinal axis of arm member 40. And when in this position of FIG. 4, the T-shaped finger member 50 may translate at fixed positions relative to arm 40 in a plane of travel that is 90° relative to the longitudinal axis defined by arm member 40. As will also be described in further detail below, when the head member 14 is in the configuration of FIG. 4, it is particularly adapted to retain and support chair-molding articles 310 that are positioned so as to be mounted on a side-wall 150.

With the apparatus 10 for supporting molding pieces being described above, its method of use will now be discussed.

With reference to FIGS. 2 and 5, when it is desired to use apparatus 10 to support a crown molding piece 300 that is to mounted to a wall joint formed by a side wall 150 and ceiling wall 200, the head member 14 of apparatus 10 is first configured such the T-shaped arm members 50 each extending from respective arm members 40 and 42 are disposed in planes perpendicular to each other. Next, the body members 16, 18 and 20 of elongate body member 12 are positioned relative to one another (via set-screw assemblies 24 and 26) such the stop member 22 at the bottom end of body member 12 is disposed adjacent the floor surface 100, while the head assembly 14 is disposed adjacent the side-wall 150 and ceiling surfaces 200, via T-shaped arm members 50. With particular regards to the head assembly 14, the T-shaped arm member 50 extending from arm member 40 is positioned against the ceiling wall 200 while the T-shaped arm member 50 extending from arm member 42 is positioned against side-wall 150.

As mentioned above, the spring assembly 32 provided in head-cap assembly 30 securely positions apparatus 10 in a position prescribed by a user. With more particularity and continuing reference to FIG. 1, when a user has positioned the head assembly 14 such that it is positioned at a desired location relative to side-wall 150 and ceiling wall 200, the user then applies an upward force onto body member 12 causing body member 20 to retract into head assembly 30 thus causing the spring 34 of spring assembly 32 to load (e.g., compress). Now, with the spring 34 in a loaded state, the user slides stop member 22 at the end of bottom member 16 along the floor surface 100, and preferably towards side-wall 150 until a sufficient downward force is imparted upon stop member 22 via the load of spring assembly 32 such that apparatus 10 is securely fastened in place.

With the apparatus 10 now securely positioned between floor surface 100 and side-wall 150 and ceiling wall 200, a user then guides a piece of crown molding in the space defined between side-wall 150, ceiling wall 200, arm member 40 and arm member 42 (hereinafter "encapsulating space 400"). And once the piece of crown molding 300 is positioned in encapsulating space 400, it may be orientated in a prescribed position as it is to be mounted against side-wall 150 and ceiling wall 200.

With one end portion of the crown molding piece 300 being retained within encapsulating space 400, the user can then either slide the opposing end portion of the crown molding piece 300 in an encapsulating space of another apparatus 10, or the user may simply begin to mount the crown molding piece 300 against side-wall 150 and ceiling wall 200, which mounting preferably begins at the opposing end portion of the crown molding piece 300 that is not being retained within the encapsulating space 400 defined by the head assembly 14 of apparatus 10.

With reference now to FIGS. 4 and 6, when it is desired to use apparatus 10 to support a molding piece 310 that is to mounted against a side wall 150, the head member 14 of apparatus 10 is first configured such the T-shaped arm members 50 each extending from respective arm members 40 and 42 are disposed in parallel planes relative to one another as shown in FIGS. 4 and 6 and also discussed above. Next, the body members 16, 18 and 20 of elongate body member 12 are positioned relative to one another (via set-screw assemblies 24 and 26) such the stop member 22 at the bottom end of body member 12 is adjacent the floor surface 100, while the head assembly 14, and particularly each front face surface of the parallel extending T-shaped members 50, is adjacent the side-wall 150.

When a user has positioned the head assembly 14 such that it is positioned at a desired location relative to side-wall 150, the user then applies an upward force onto body member 12 causing body member 20 to retract into head assembly 30 thus causing the spring 34 of spring assembly 32 to load (e.g., compress). Now, with the spring 34 in a loaded state, the user slides stop member 22 at the end of bottom member 16 along the floor surface 100, and preferably towards side-wall 150 until a sufficient downward force is imparted upon stop member 22 via the load of spring assembly 32 such that apparatus 10 is securely fastened in place.

With the apparatus 10 now securely positioned between floor surface 100 and side-wall 150, a user then guides a molding piece 310 (e.g., chair molding) within the space defined between side-wall 150, arm member 40 arm member 42 and a T-shaped arm member 50 (hereinafter "encapsulating space 410"). And once the molding piece 310 is positioned within encapsulating space 410, it may be orientated in a prescribed position as to be mounted against side-wall 150.

With one end portion of the molding piece 310 being retained within encapsulating space 410, the user can then either slide the opposing end portion of the crown molding piece 310 in an encapsulating space of another apparatus 10, or the user may simply begin to mount the molding piece 310 against side-wall 150, which mounting preferably begins at the opposing end portion of the molding piece 310 that is not being retained within the encapsulating space 410 defined by the head assembly 14 of apparatus 10.

Therefore, what has been described above is an apparatus 10 that is adaptable and enables a single user to mount molding pieces to either a wall surface (e.g., chair molding) or to the wall joint formed by a side-wall and ceiling wall (e.g., crown molding). The present invention apparatus 10 is further adjustable to accommodate various sizes and configurations of molding pieces via the aforesaid adjustability of the T-shaped arm members 50 relative to the arm members 40 and 42 of the head assembly 14. Furthermore, the overall length of the present invention apparatus 10 is adjustable (via elongate body 12) so as to facilitate mounting of molding pieces at various distances relative to a floor surface. An additional advantage is that while the present invention apparatus 10 is encapsulating a molding piece that is to be mounted, that molding piece is still nevertheless movable such that a user may make the necessary adjustments to the orientation of the molding piece so as to be mounted properly and uniformly.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. An apparatus for supporting a molding piece against at least a sidewall surface at a distance from a floor surface, the apparatus comprising:

an elongate body having opposing first and second ends;

a head assembly coupled to the first end of the elongate body, the head assembly being configured to encapsulate and support a portion of the molding piece adjacent said at least a sidewall at a prescribed distance from said floor surface when said second end of said elongate body portion is adjacent said floor surface and said first end is adjacent said at least a sidewall, said head assembly including:

(a) an L-shaped member having first and second arm members extending perpendicular to one another wherein said L-shaped arm member is pivotally coupled to said first end of said elongate body at a corner portion of said L-shaped arm member wherein said first and second arm members join with one another; and (b) first and second T-shaped members respectively coupled to end portions of said first and second arm members of said L-shaped member, wherein each said T-shaped member is configured to be disposed against a wall surface.

2. The apparatus of claim 1 wherein the elongate body is operable to have an adjustable length.

3. The apparatus of claim 1 wherein the elongate body includes a plurality of body members adjustable relative to one another whereby the elongate body is configurable to have an adjustable length.

4. The apparatus of claim 1 wherein the first end of the elongate body includes a spring assembly operable to provide a normal force to the second end of the elongate body disposed adjacent said floor surface and to said head assembly disposed adjacent at least a sidewall for securing said apparatus in place when it is supporting said molding piece at a prescribed distance from said floor surface.

5. The apparatus of claim 1 wherein said head assembly is pivotally coupled to said first end of said elongate body.

6. The apparatus of claim 1 wherein the head assembly is adjustable to form at least first and second configurations whereby when adjusted in a first configuration the head assembly encapsulates and supports a portion of a molding piece against a sidewall at a prescribed distance from said floor surface and when adjusted in said second configuration the head assembly encapsulates and supports a portion of a molding piece against a wall joint formed by a sidewall and ceiling wall when said second end of said apparatus is adjacent said floor surface.

7. The apparatus of claim 1, wherein the head assembly is adjustable to encapsulate and support molding pieces having various dimensions adjacent said at least a sidewall at a prescribed distance from said floor surface.

8. An apparatus for supporting a molding piece against a wall surface at a prescribed distance from a floor surface when said molding piece is to be mounted to a wall surface, said apparatus comprising:

an elongate body operable to have an adjustable length, said elongate body having opposing first and second ends;

a head assembly pivotally coupled to said first end of said elongate body with said head assembly being configured to encapsulate and support a portion of said molding piece adjacent a wall surface at a prescribed distance from said floor surface, said head assembly being configurable by a user to form first and second configurations whereby when adjusted in a first configuration said head assembly encapsulates and supports a portion of a molding piece against a sidewall at a prescribed distance from said floor surface and when adjusted in said second configuration said head assembly encapsulates and supports a portion of a molding piece against a wall joint formed by a sidewall and ceiling wall when said second end of said apparatus is adjacent said floor surface, said head assembly being further adjustable by said user to encapsulate and support molding pieces having various dimensions adjacent either a said side wall or a said wall joint formed by a sidewall and ceiling wall, wherein said head assembly includes:

(a) an L-shaped member having first and second arm members extending perpendicular to one another wherein said L-shaped arm member is pivotally coupled to said first end of said elongate body at a corner portion of said L-shaped arm member wherein said first and second arm members join with one another; and (b) first and second T-shaped members respectively coupled to end portions of said first and second arm members of said L-shaped member, wherein each said T-shaped member is configured to be disposed against a wall surface.

9. The apparatus of claim 8 wherein said adjustable elongate body includes a plurality of body members moveable and lockable relative to one another.

10. The apparatus of claim 9 wherein the first end of the elongate body includes a spring assembly operable to provide a normal force to the second end of the elongate body disposed adjacent said floor surface and to said head assembly disposed adjacent a wall surface for securing said apparatus in place when it is supporting said molding piece at a prescribed distance from said floor surface.

11. The apparatus of claim 8 wherein each said T-shaped member is adjustable to extend a prescribed distance distally from a respective end portion of each first and second arm member of said L-shaped member along a respective longitudinal axis respectively defined by said first and second arm member of said L-shaped member.

12. The apparatus of claim 11 wherein at least said first T-shaped member includes a T-shaped body portion and an elongate body member extending from said T-shaped body portion, said elongate body member having a longitudinal axis disposed in a plane perpendicular to a plane defined by said T-shaped body portion.

13. The apparatus of claim 12 wherein said first T-shaped member is further adjustable relative to said coupled first arm member such said longitudinal axis of said elongate body member extending from said T-shaped body portion is disposed in a plane perpendicular to said longitudinal axis defined by said first arm member of said L-shaped member.

* * * * *